US008668003B2

(12) United States Patent
Osmundsen et al.

(10) Patent No.: US 8,668,003 B2
(45) Date of Patent: Mar. 11, 2014

(54) CEMENT HEAD WITH INTEGRATED ENERGY SUPPLY FOR OPERATING VALVES

(75) Inventors: Stian Osmundsen, Sandnes (NO); Krzysztof Klimas, Sandnes (NO)

(73) Assignee: Seawell Oil Tools AS, Stavanger (NO)

( * ) Notice: Subject to any disclaimer, the term of this patent is extended or adjusted under 35 U.S.C. 154(b) by 292 days.

(21) Appl. No.: 13/120,165

(22) PCT Filed: Oct. 23, 2009

(86) PCT No.: PCT/NO2009/000366

§ 371 (c)(1),
(2), (4) Date: Mar. 22, 2011

(87) PCT Pub. No.: WO2010/047600

PCT Pub. Date: Apr. 29, 2010

(65) Prior Publication Data

US 2011/0168380 A1 Jul. 14, 2011

(30) Foreign Application Priority Data

Oct. 23, 2008 (NO) ..... 20084470

(51) Int. Cl.
*E21B 33/16* (2006.01)

(52) U.S. Cl.
USPC ..... 166/70; 166/153; 166/291

(58) Field of Classification Search
USPC ..... 166/153, 170, 291, 70
See application file for complete search history.

(56) References Cited

U.S. PATENT DOCUMENTS

| | | | |
|---|---|---|---|
| 5,293,933 | A | 3/1994 | Brisco |
| 2007/0131416 | A1 | 6/2007 | Odell, II et al. |
| 2008/0251249 | A1 | 10/2008 | Carlson |

FOREIGN PATENT DOCUMENTS

| | | |
|---|---|---|
| EP | 0 556 007 | 8/1993 |
| GB | 2 350 141 | 11/2000 |
| WO | 2008 082307 | 7/2008 |

OTHER PUBLICATIONS

International Search Report issued Apr. 20, 2010 in PCT/NO09/000366 filed Oct. 23, 2009.
Search Report issued Mar. 31, 2009 in Norwegian Patent Application No. 20084470.

*Primary Examiner* — Giovanna Wright
(74) *Attorney, Agent, or Firm* — Oblon, Spivak, McClelland, Maier & Neustadt, L.L.P.

(57) ABSTRACT

A cement head used for performing cementing jobs in downhole operations is provided. The cement head includes wireless signaling means, an integrated energy supply, activating means for pneumatic operated valves in cement head, and controller means for controlling said energy supply for activation of at least one valve based on received signals through the wireless signaling means.

8 Claims, 2 Drawing Sheets

CEMENT HEAD WITH INTEGRATED ENERGY SUPPLY FOR OPERATING VALVES

FIELD OF THE INVENTION

The present invention relates to a cementing head used for cementing in downhole operations. More specifically, the invention relates to means for controlling and operating such cementing head.

BACKGROUND OF THE INVENTION

Cementing heads are well known in the field of petroleum exploration, well completion, production and abandonment. A cementing job is typically performed for pumping wet cement down a well to fill the space between the casing and the formation and for closing a well path. In this operation a cementing head is the connection between the cement pump and the cement line in the well, and is used for controlling valves located in the flow line of cement, said valves control the release of wiper plugs separating cement flow from fluids in front of and back of it.

Applicants' own publication WO-2008/082307 with the title "Pressure driven apparatus for sequential control of a cement head" show related art.

Operation of a cement head is described, and FIG. 2A in said WO-publication shows a control panel with direct pneumatic control of valves on the cement head by using pressurized gas. This is achieved with a control line comprising an air hose connected between the control panel and the cement head.

The pneumatic remote control thus removes the need to operate the valves manually, but still requires personal to be present in the red zone on drill floor. FIG. 1 in the accompanying figures in the disclosure shows the set-up with said pneumatic remote control.

The QHSE (Quality, Health, Safety & Environment) policy of most rig operators is to reduce the number of persons in the red zone as much as possible. The pneumatic remote control also depends on use of a swivel. This is a mayor drawback as the swivel reduce permitted rpm rate. During liner cementing operation, rotation rate sometimes exceeds the permitted rate. If the swivel fails, the connection between the cement head and, the control line can represent a risk. With hoses connecting the control panel to the cement head, the risk of equipment being damaged during operation increases since hoses often are not properly protected from the environment and activities on drill floor.

There is therefore a need for operating a cement head without exposing personnel to risk.

The present invention suggests removing the control line and applying wireless controlled means instead. This will result in several technical advantages and reduced risk to personnel. The need to have personal in the red zone will be reduced, thereby reducing risk to personnel due to falling objects. It will also remove problems with swivel on liner jobs. The same cement head can also be used on both liner and casing cementing jobs.

A wireless controlled cement head presents several technical challenges to be solved. One of these is how to provide sufficient energy for operating valves used for releasing wiper plugs.

This and other aspects are solved in the present invention as described in the detailed description.

SUMMARY OF THE INVENTION

The present invention is defined by a cement head for performing a cementing job, said cement head comprising valves and means for controlling and operating said valves located in a flow line of cement, said valves controlling the release of balls and wiper darts separating cement flow from fluids in front of, and back of said balls and wiper darts, said cement head further comprises wireless signaling means, integrated energy supply, and controller means for controlling said integrated energy supply for activation and operation of at least one valve based on received signals through said wireless signaling means.

The cement head is characterized in that said wireless signaling means comprises two-way communication, and that said integrated energy supply comprises tanks with pressurized gas being controlled for operating pneumatic operated valves Additional features of the invention are described in the dependent claims, and will be explained as the following detailed description is read in conjunction with the figures which illustrate embodiments.

The present invention has been developed due to a need for safer operation when performing cementing jobs. To reduce the risk, the invention suggests removing the pneumatic control line connected to a cement head, and introducing wireless control means instead.

By applying remote wireless control for operating a cementing head, an operator can be located in a safe zone, and the risk to personnel will be minimal.

A cement head without connected wires and hoses for controlling it has introduced technical challenges that are solved by the present invention.

BRIEF DESCRIPTION OF THE DRAWINGS

The novel cement head will now be described in more detail with reference to the drawings.

DETAILED DESCRIPTION OF THE PREFERRED EMBODIMENTS

Figure 1:
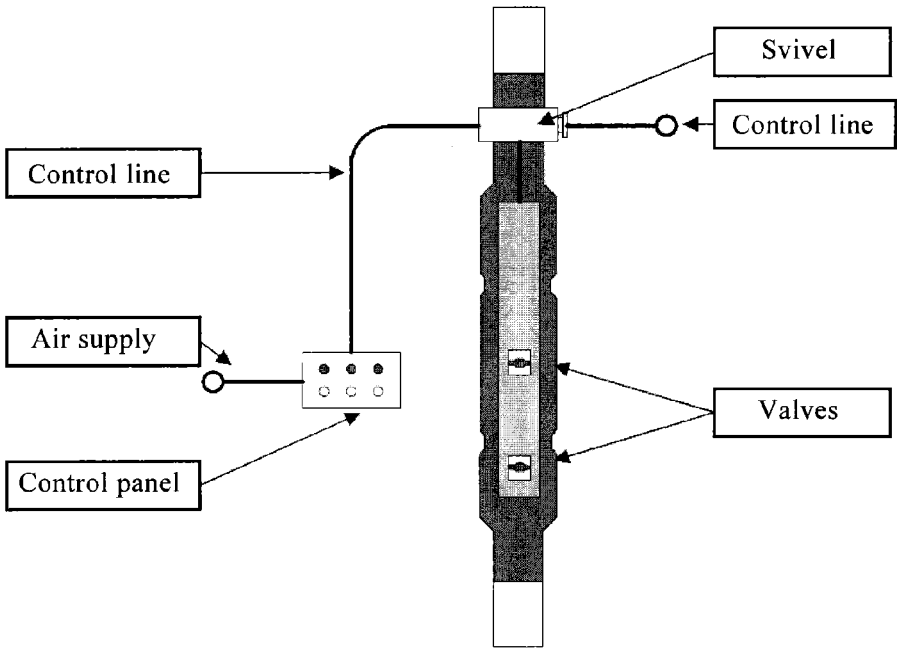
FIG. 1 shows operation of a cementing head operated by using a connected control line.

FIG. 1 shows a cementing head operated by using a pneumatic control line connected to the cement head. This is the preferred method used up to now, and the figure shows a cement head with two valves. There are also cement heads with three valves. The control panel is used for controlling the supply of pressurized gas to the control line and thus to the cement head. This is achieved by supplying pressurized gas to the control panel, and operating valves in the control panel to control the supply of pressurized gas to the cement head. The control line comprises hoses connected to the cement head by means of a swivel, which allows the cement head to rotate while hoses connected are preferably stationary.

During normal operation, i.e. circulation of well fluid, all valves in the cement head are closed. The fluid will then pass through the head through bypass channels. Behind each valve there are balls or wiper darts for separating cement flow from well fluids in front of and back of it. Fins on said darts will function as seals against the pipe they are running through. The darts also ensure cleaning of the pipes when running through them. The valves control the release of said balls and wiper darts when operating the cement head.

When a cement job is to be carried out a sequential operation of the valves is performed, the first valve, i.e. the one at the bottom, is opened by operating the control panel. This will result in a direct supply of compressed gas through the connected hose, and the first dart will be dropped. Cement supplied through the cement line is then pumped through the cement head. The next valve is activated to open from the control panel to open when the desired amount of cement has been pumped through the cement head. This will result in that the second dart is dropped. The cement will then be located between the two darts. For pumping the cement through the pipe line, regular well fluid is normally used.

Figure 2:
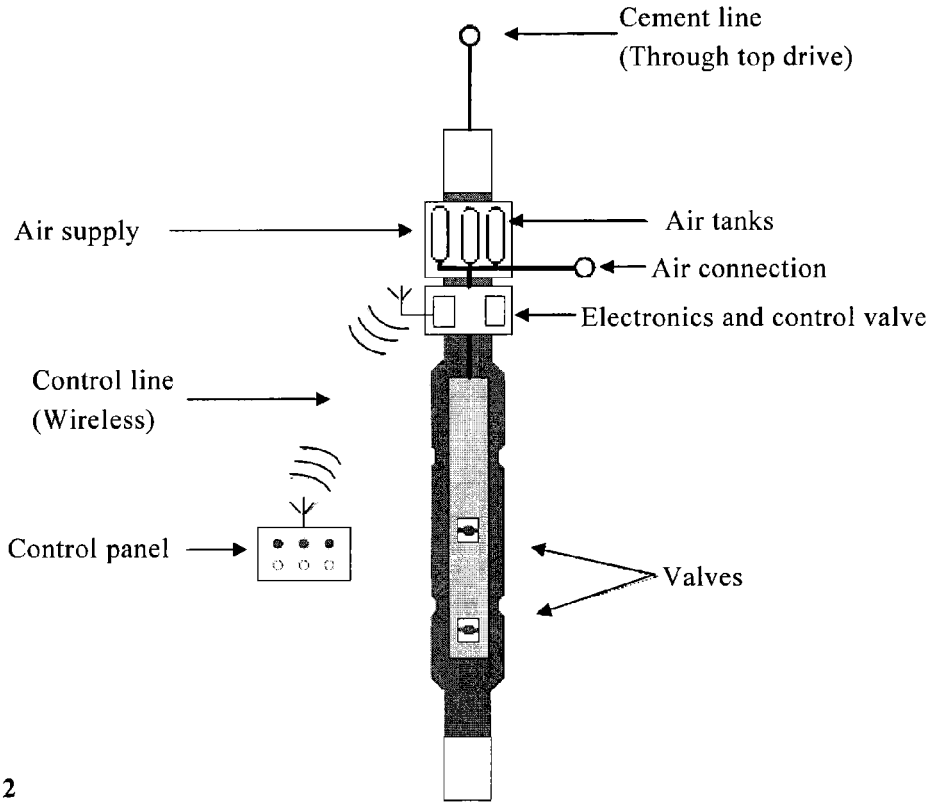
FIG. 2 shows a cementing head according to the invention.

FIG. 2 shows a cementing head according to the present invention, i.e. the means for performing a cementing job without supplying pressurized gas through connected control lines.

The cement head comprises means for controlling valves located in the flow line of cement, said valves control the release of balls and wiper darts separating cement flow from fluids in front of and back of it. The cement head may comprise two or more valves to be controlled and where at least one of said valves is pneumatic operated by pressurized gas.

Said cement head is characterized in that it further comprises wireless signaling means for communication. This may be all types of wireless communication means, e.g. infrared light, ultrasound, radio waves etc.

Radio waves are considered to be a good and practical solution for communication means, due to low energy consumption, reliable technology, and not very direction dependent. Low energy consumption is very important regarding EX certification and safe operation in gas-explosive endangered areas. Radio signals are further transmitted at relatively high frequencies, ensuring a quick response.

As a minimum, the cement head comprises wireless receiver means for receiving signals controlling it. Equipping the cement head with two way communications, e.g. receiver and transmitter will also enable feedback information to be given to the operator. By providing means for monitoring the operating states of the valves in the cement head, an operator will not have to perform a visual check of the status of the cement head. Different kinds of information can be sent to the operator operating the wireless remote control thereby facilitating a more user-friendly operation. An example of such information is verification of successful opening of valves and dropping of darts and balls.

If a digital, serial communication protocol is implemented, failsafe routines and message checksum can ensure reliable operation and minimize risk of interrupts in the operation.

The cement head according to the invention comprises integrated energy supply. This means energy for operating electrical driven means, i.e. electric power, e.g. a battery pack. Electrical driven means is the electronics comprising receiver, controller, sensors etc. It is also power to at least one valve which is an electrical activated and operated valve.

Integrated energy supply also means air or other pressurized gases, e.g. nitrogen, stored in pressurized tanks that are integrated on the cement head for driving the pneumatic operated valves.

In one embodiment a module comprising air is mounted at the top of the cement head. This module comprises a set of high pressure composite air tanks for providing an energy supply by means of pressurized air, a radio controlled unit and a pneumatic system for operating the pneumatic driven valves in the cement head. A cover will preferably protect the components. Providing connectors on the cover will ensure easy maintenance without removing the cover, e.g. access for battery charger, refill for air etc.

Refilling of said pressurized air tanks may be performed by external supply means through a connection on the cement head, e.g. swivel, by connecting a hose supplying the pressurized air. This method for supplying pressurized air may also be used in case the pressurized air from the air tanks drops below the pressure necessary to drive the pneumatic valves during a cementing operation. If this is the case, the pneumatic driven valves may receive pressurized air directly from the external means through the connected hose.

There are other ways of producing pressurized air. It may be generated by the flow running through the cement head. It may also be produced by mechanical generation, e.g. an onboard compressor on the cement head.

In one embodiment of the invention, there is monitoring means comprising one or more pressure sensors for monitoring pressure of pressurized air. If the pressure falls below a certain level a signal may be trigged and further actions can be initiated, e.g. starting compressors for generating more pressurized air.

According to the present invention, the cement head also comprises controller means for controlling said energy supply for activation of at least one valve based on received signals through said wireless signaling means.

Said controller means comprises CPU and I/O units for operating and communicating with an electrical operated valve. I/O units can also receive status information regarding pressure, valve positions, battery level etc. This information can then be transmitted to the wireless remote control for giving valuable information to an operator.

In one embodiment, the electronics comprising CPU, transceiver, I/O unit, controller, electrical operated solenoid valves, pressure sensor for monitoring air pressure, battery pack, and battery level sensor are all located in the same base unit on the cement head. This unit is preferably encapsulated and sealed to resist a rough environment.

In case of failure in the wireless operation, it is possible to operate the valves on the cement head manually.

Figure 3:
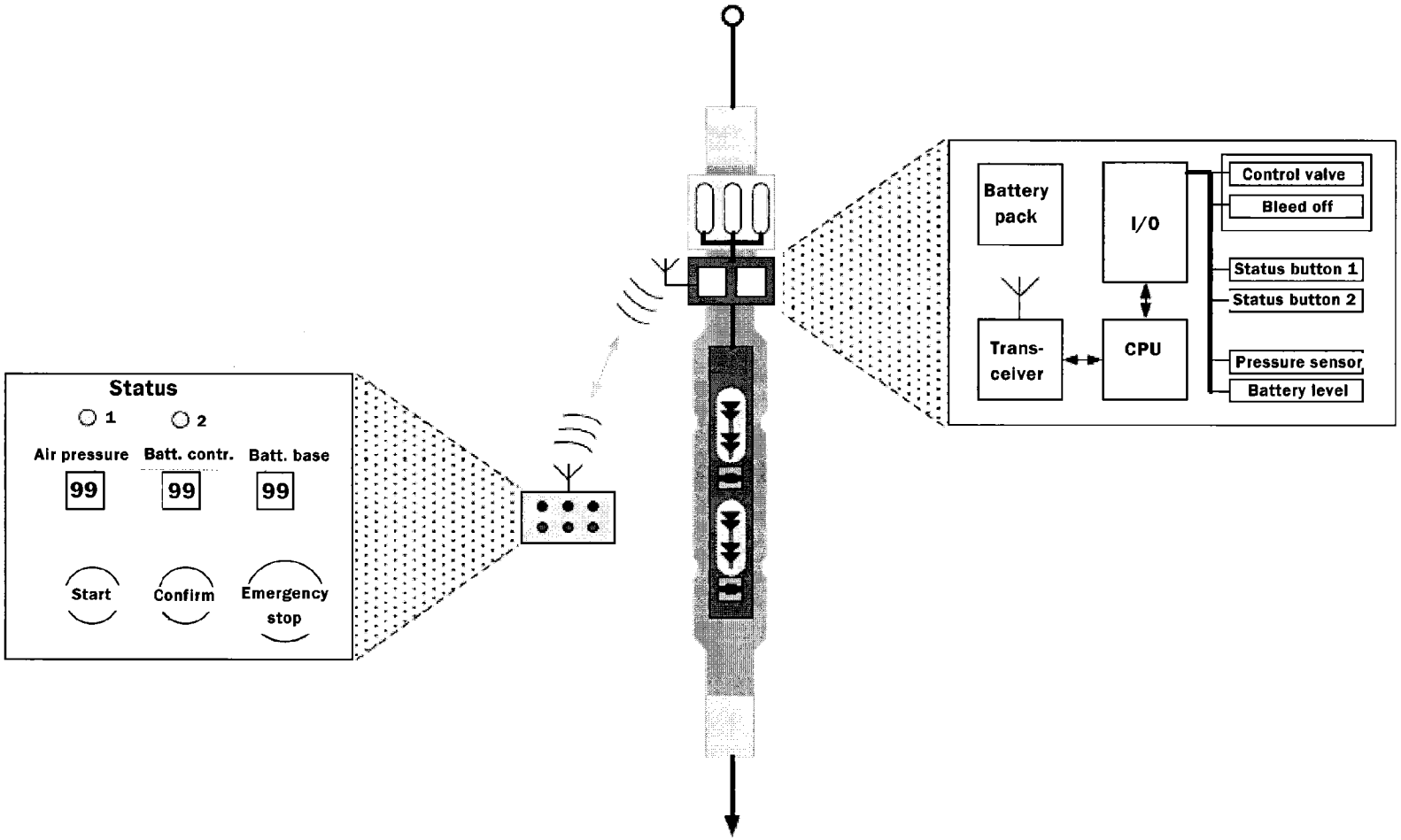
FIG. 3 shows an example of how to operate the cementing head.

FIG. 3 shows an example of how to operate the cementing head according to the present invention. The figure also shows an example of controlling the cement head by wireless means in a remote control panel communicating with signaling means located in a base unit mounted on the cement head.

The figure shows a cement head comprising two valves and means for controlling the valves located in a flow line of cement. The valves shown in the figure are closed and each holds a wiper dart to be dropped. This is the situation when the cement head is set up and ready to start a cementing operation. The pressurized tanks for driving pneumatic driven valves are located at the top of the cement head. Below the pressurized tanks, signaling and controller means are shown.

The first step when performing a cementing job using the novel and described cement head is to rig it up and activate it. Communication between the base unit on the cement head and the wireless control panel will then be established. Status information of parameters in the cement head can then be sent to the wireless control panel.

The status information may comprise information about circulation, signal strength of wireless connection, air pressure, battery level, loading of darts, position of valves, parameters telling the operator if the cement head is then ready for performing a wireless controlled cementing job. Sensors for detecting the position of the valves may comprise simple switches. The detail level of the status information sent to the control panel may vary according to type and number of sensors implemented in the cement head etc. In its simplest form the information may only be a ready signal sent from the transmitter in the well to the wireless control panel after the cement head has performed a self check. This may be indicated by a lit green status light on the remote control.

By using a remote control with a display, more detailed and informative information with both symbols and text may be given to the operator.

The remote control in FIG. 3 shows information about air pressure of the pressurized air, and battery information of the remote control and base unit in the cement head. There are also two status lights which will be further described below. The first may indicate that wireless connection is established.

When step 1 is performed, i.e. the cement head is rigged up and activated, and status information may be shown as two yellow lit LEDs indicating that wireless connection is established, both valves in the cement head are closed, darts are loaded, and the cement head is ready for operation. The air pressure is indicated with a max value as is the battery indicators for both the remote controller and the base unit. The colour of the status lights may change to indicate the state of different parameters.

The second step is to start the cementing job. The receiver means in the well head will receive control signal from the wireless control panel when an operator press "start" and "confirm" at the same time. The I/O unit in the base unit will then send a control signal to the control valve which is driven by electrical means, i.e. battery and solenoid.

The control valve will then open for the supply of pressurized air from the air tanks, thus operating the first pneumatic driven valve. When the first pneumatic driven valve is opening, it will at the same time start closing or shut off the normal circulation path. When the first valve is completely open, the control valve is deactivated thereby closing supply of pressurized air. This process may be performed automatically by the means in the base unit, i.e. sensors, I/O unit, controller etc. It may also be controlled by the operator via the remote control, by pressing the "start" button when the status light of the first LED changes colour. The air pressure indicated on the control panel will show a little drop in pressure due to the used pressurized air.

When the first valve is opened, the first dart is dropped, and cement can then be pumped through the cement head. The outer diameter of the darts may be adjusted such that they upon release either is dropped to the bottom of the well, or will stick to the wall of the pipe before the cement is supplied followed by the next dart.

The third step is to perform and monitor the cement job. The operator should then observe the states of air pressure and battery levels.

The forth step is performed after the desired amount of cement has been pumped. The actions performed in this forth step will be similar as the actions performed in step 2, except for that the second valve is opened and the second dart is dropped when the operator press "start" and "confirm" at the same time. The second status light on the remote control will change colour when the second valve is fully open, confirmed by signals sent from the cement head. Again, it will be observed that the air pressure indicated on the control panel will drop slightly due to further use of pressurized air. The battery level will also drop slightly.

The cement will now be located between said first and second dart, and will be guided down the well by means of the pressure form the normal flow.

The fifth step is performed when the cement job is finished, and comprises clean up cycles performed to properly clean up the cement head. In this operation both main and bypass channels are cleaned. This may be performed by operating the control valve in the cement head by pressing "start" and "confirm" at the same time. The wireless control panel will then send the clean up command to the base unit.

The sixth and last step is to bleed of remaining air to ensure that no pressurized air is stored in the air tanks. This operation may be performed by operating the electrical driven control valve, or by operating a separate bleed-off valve.

The description of the present invention has focused on a cement head comprising one electrically operated solenoid valve for controlling the supply of pressurized air to pneumatic and sequential operated valves controlling the dropping of darts.

A man skilled in the art will understand that the means enabling wireless control of the cement head may also be used in other but similar tools, e.g. a ball drop head with only one wireless controlled valve for dropping one ball.

Another embodiment within the scope of the invention is to equip all valves with electrical controlled solenoid means. The operation of the valves controlling darts will then differ in that the valves will be actuated by electrical means and opened by pressurized air. The control of the sequence and order the valves are to open is then controlled by the CPU controlling the operation steps to be performed. The next step will be initiated when pressurized air is released.

Said examples only show the principles and shall not be regarded as restricting the scope of the invention as defined in the set of claims.

The invention claimed is:

1. A cement head, comprising:

valves;

means for controlling and operating said valves located in a flow line of cement, said valves controlling release of balls and wiper darts separating cement flow from fluids in front of, and back of said balls and wiper darts;

wireless signaling means;

an integrated energy supply; and controller means for controlling said integrated energy supply for activation and operation of at least one valve based on received signals through said wireless signaling means, wherein said wireless signaling means comprises two-way communication, and said integrated energy supply comprises tanks with pressurized gas being controlled for operating pneumatic operated valves.

2. A cement head according to claim 1, wherein at least one valve is both pneumatically activated and operated by said integrated energy supply which is pressurized gas.

3. A cement head according to claim 1, wherein at least one valve is electrically activated and pneumatically operated by said integrated energy supply which is electricity and pressurized gas.

4. A cement head according to claim 1, wherein said pressurized gas is generated by a flow in the cement head.

5. A cement head according to claim 1, wherein said pressurized gas is mechanically generated.

6. A cement head according to claim 1, further comprising monitoring means for monitoring operating states of said valves.

7. A cement head according to claim 6, wherein said monitoring means comprises one or more pressure sensors for monitoring pressure of pressurized gas.

8. A cement head according to claim 1, wherein operating states of the valves are sent via said wireless signaling means to a remote control for displaying said operating states.

* * * * *